US012678657B2

(12) United States Patent
Kim et al.

(10) Patent No.: US 12,678,657 B2
(45) Date of Patent: Jul. 14, 2026

(54) SYSTEM AND METHOD FOR CONTROLLING A CARDIAC ENHANCEMENT TRAINING DEVICE

(71) Applicants: Hoonyoung Kim, Franklin Park, IL (US); Hyunsook Kim, Franklin Park, IL (US)

(72) Inventors: Hoonyoung Kim, Franklin Park, IL (US); Hyunsook Kim, Franklin Park, IL (US)

( * ) Notice: Subject to any disclaimer, the term of this patent is extended or adjusted under 35 U.S.C. 154(b) by 95 days.

(21) Appl. No.: 18/670,094

(22) Filed: May 21, 2024

(65) Prior Publication Data

US 2025/0288858 A1 Sep. 18, 2025

Related U.S. Application Data

(63) Continuation-in-part of application No. 18/605,240, filed on Mar. 14, 2024, now abandoned.

(51) Int. Cl.
*A63B 22/00* (2006.01)
*A63B 22/02* (2006.01)
(Continued)

(52) U.S. Cl.
CPC ..... *A63B 22/0046* (2013.01); *A63B 22/0207* (2015.10); *A63B 22/025* (2015.10);
(Continued)

(58) Field of Classification Search
CPC ..... A63B 21/00181; A63B 21/04; A63B 21/0407; A63B 21/0414; A63B 21/0421;
(Continued)

(56) References Cited

U.S. PATENT DOCUMENTS 2,819,755 A * 1/1958 Berger ..... A61H 3/008 482/69
3,778,052 A * 12/1973 Andow ..... A61H 3/04 482/67
(Continued)

FOREIGN PATENT DOCUMENTS

CN 105797308 A * 7/2016 ..... A63B 22/0207
CN 110339533 A * 10/2019 ..... A63B 23/14
(Continued)

OTHER PUBLICATIONS

International Search Report re application No. PCT/US2025/019707, dated May 21, 2025.
(Continued)

*Primary Examiner* — Gary D Urbiel Goldner
(74) *Attorney, Agent, or Firm* — Husch Blackwell LL.P

(57) ABSTRACT

A frame for use with a cardiac enhancement training device is provided. The frame includes a height adjustment system including one or more handrails designed for a user to brace themselves on and to relieve a first amount of weight from the user's joints. An anti-gravity support system includes one or more anti-gravity straps designed to relieve a second amount of weight from the user's lower joints. The frame further includes one or more vertical posts and a slidable track connected to the one or more vertical posts. The one or more handrails are connected to the slidable track, and a tension force applied to the slidable track is provided by one or more bands designed to support the first amount of weight.

15 Claims, 7 Drawing Sheets

(51) Int. Cl.
*A63B 24/00* (2006.01)
*A63B 69/00* (2006.01)

(52) U.S. Cl.
CPC ..... *A63B 24/0062* (2013.01); *A63B 24/0087* (2013.01); *A63B 69/0028* (2013.01); *A63B 2024/0065* (2013.01); *A63B 2069/0037* (2013.01); *A63B 2225/093* (2013.01); *A63B 2230/015* (2013.01); *A63B 2230/062* (2013.01)

(58) Field of Classification Search
CPC ..... A63B 21/0428; A63B 21/0435; A63B 21/0442; A63B 21/055; A63B 21/0552; A63B 21/16; A63B 22/0046; A63B 22/0207; A63B 26/00; A63B 26/003; A63B 69/0028; A63B 69/0057; A63B 69/0059; A63B 69/0064; A63B 2069/0037; A63B 71/0009; A63B 71/0054; A63B 2071/0063; A63B 2071/0072; A63B 2213/00; A63B 2229/09; A63B 2229/093
See application file for complete search history.

(56) References Cited

U.S. PATENT DOCUMENTS 4,591,150 A * 5/1986 Mosher ..... A63B 21/1663 482/125
5,637,066 A * 6/1997 Chang ..... A63B 21/0004 482/121
5,954,622 A * 9/1999 Olschansky ..... A63B 21/4011 482/133
6,520,891 B1 2/2003 Stephens, Jr.
6,821,233 B1 * 11/2004 Colombo ..... A61H 1/0262 601/5
7,288,052 B1 * 10/2007 Guillaume ..... A63B 23/0211 482/121
9,205,297 B2 * 12/2015 Kaehler ..... A63B 23/0355
10,265,565 B2 * 4/2019 Jue ..... A63B 69/0064
10,376,734 B1 * 8/2019 Razon ..... A61B 5/0077
2001/0019987 A1 * 9/2001 Conner ..... A63B 21/4033 482/122
2005/0164839 A1 7/2005 Watterson et al.
2005/0255971 A1 * 11/2005 Solomon ..... A63B 23/1209 482/54
2008/0070757 A1 * 3/2008 Albert ..... A63B 71/0009 482/54
2010/0000546 A1 * 1/2010 Park ..... A63B 21/00181 128/845
2014/0087922 A1 * 3/2014 Bayerlein ..... A63B 21/00181 482/54
2015/0196796 A1 7/2015 Murray et al.
2015/0251048 A1 9/2015 Dalebout
2016/0038785 A1 2/2016 Netter et al.
2018/0280756 A1 * 10/2018 Nakashima ..... A63B 21/4035
2021/0005106 A1 * 1/2021 Otsuki ..... A61H 1/024
2021/0244997 A1 8/2021 Jiang
2022/0331192 A1 * 10/2022 Nagasue ..... A61H 3/00
2022/0331664 A1 * 10/2022 Nakamura ..... A61H 1/0262
2022/0362091 A1 * 11/2022 Yamazaki ..... A61B 5/112
2022/0387244 A1 * 12/2022 Matsumoto ..... A63B 24/0062
2022/0395726 A1 * 12/2022 Shintani ..... A63B 22/02
2022/0401286 A1 * 12/2022 Shimada ..... A63B 24/0087
2022/0406432 A1 * 12/2022 Kikuchi ..... A61B 5/1038

FOREIGN PATENT DOCUMENTS

CN 107693301 B * 12/2019 ..... A61H 1/0229
CN 211561726 U 9/2020
CN 116271695 A * 6/2023 ..... A63B 22/0235
DE 202010004244 U1 * 6/2011 ..... A63B 24/0062
DE 102010003344 A1 * 9/2011 ..... G16H 20/30
EP 4454627 A1 * 10/2024 ..... A63B 22/14
WO WO-2022066950 A1 * 3/2022 ..... G06F 3/016

OTHER PUBLICATIONS

Written Opinion re application No. PCT/US2025/019707, dated May 21, 2025.

* cited by examiner

SYSTEM AND METHOD FOR CONTROLLING A CARDIAC ENHANCEMENT TRAINING DEVICE

FIELD OF THE INVENTION

The present disclosure generally relates to a cardiac enhancement training device including an adjustable height assembly designed to adjust a height of a handrail designed support at least a portion of a user's body weight. Further, the present disclosure relates to a method for automatically adjusting one or more operational settings of the cardiac enhancement training device.

BACKGROUND OF THE INVENTION

Cardiovascular training, also known as cardio or aerobic exercise, is beneficial for maintaining and improving heart health, circulation, weight management, lung health, and other physical and mental aspects. Some forms of cardiovascular training recommended by the American Heart Association include brisk walking, jogging, and running. Accordingly cardiac enhancement training devices are popular because they allow users to participate in cardio exercise indoors regardless of the weather, time of day, or geographical location. Further, cardiac enhancement training devices may cause less damage to the user's joints because the cardiac enhancement training device can include a shock absorption or cushioning system that can reduce the impact on the user's joints as compared to exercising outside on hard surfaces. Some traditional cardiac enhancement training devices can include treadmills, ellipticals, and stair climbers.

However, running, jogging, and walking on a cardiac enhancement training device can still cause damage to a user's joints because the user is continuously shifting their body weight and impacting their lower joints. Thus, a user may prematurely stop their workout because of an injury or to prevent an injury. In particular, inexperienced, elderly, and overweight users may be at a higher risk for injuries because of the limitations of their bodies. However, if a user cannot complete their cardio exercise, it can be difficult to improve their health.

As such, some cardiac enhancement training devices can include handrails positioned in front of and/or to the user's side so that the user can grab onto the handrails for stability when exercising. Thus, a user can support some of their body weight by holding onto the handrails, thereby relieving some pressure on their lower joints. However, the handrails may not be adjustable. Therefore, the handrails may not be at an ideal height for various users, which can make it difficult for the user to support themselves on the cardiac enhancement training device. As such, even with the aid of handrails, a user may still prematurely end their workout from joint pain.

Moreover, a user may not receive some of the benefits of cardio exercise if they do not maintain their heart rate within a target heart rate range. The user's target heart rate range can be described as a fraction or percentage of the user's maximum heart rate. The user's maximum heart rate can indicate the user's endurance for strenuous cardio exercise. Consistent cardio exercise can increase a user's maximum heart rate. Further, consistent cardio exercise can lower the user's resting heart rate, which can indicate the user's heart health. However, if a user exercises too vigorously, they may strain their heart, which can cause cardiovascular damage. Conversely, if the user exercises too gently without raising their heart rate above their resting heart rate, the user may not achieve some of the benefits of the cardio exercise. Thus, it is beneficial for a user to maintain their heart rate within a target heart rate range while exercising.

Accordingly, some cardiac enhancement training devices can include heart rate monitors to monitor the user's heart rate during use. However, heart rate monitors included in some cardiac enhancement training devices may require a user to grab or contact a specific portion of the cardiac enhancement training device. The user may not contact the heart rate monitor correctly, or the heart rate monitor can malfunction. Thus, it can be difficult for a user to measure their heart rate while exercising. Further, even if the user can measure their heart rate, they may need to determine their target heart rate and adjust an operating parameter, such as a speed setting, on the cardiac enhancement training device to maintain their target heart rate. Moreover, this is a process that the user may need to repeat multiple times throughout their workout because as the user progresses through their workout, their heart rate can change. Accordingly, the user's workout may be interrupted or hindered multiple times when the user has to measure their heart rate and adjust an operating parameter on the cardiac enhancement training device.

Therefore, there is a need in the art for a cardiac enhancement training device that reduces the risk of injury for a user during the use of the cardiac enhancement training device so that the user can complete their cardio exercise. Moreover, there is a need for a cardiac enhancement training device that automatically adjusts an operating parameter to a user's needs to reduce the chance that the user will be injured during cardio exercise and to ensure that the user can realize the physical benefits of cardio exercise.

SUMMARY

A cardiac enhancement training device is disclosed. In one instance, the cardiac enhancement training device comprises an exercise platform and a frame. The frame comprises a plurality of support posts, an upper base supported by the plurality of support posts, the upper base comprising a handrail designed for the user to grab, and an adjustable height assembly designed to change a height of the upper base by modifying a length of the plurality of support posts.

In a second aspect, the exercise platform comprises a shock absorption system designed to absorb an impact from a user's steps.

In a third aspect, the at least a portion of the plurality of support posts is hollow, and wherein the adjustable height assembly is positioned within the hollow portion of the plurality of support posts.

In a fourth aspect, the adjustable height assembly comprises a spring system designed to lower the upper base when the spring system is compressed.

In a fifth aspect, the adjustable eight assembly comprises a hydraulic cylinder system.

In another instance, the cardiac enhancement training device comprises an exercise platform comprising a deck designed to support a user, a belt designed to move around the deck, and a motor designed to drive the movement of the belt. The cardiac enhancement training device can further comprise a frame comprising a plurality of support posts with a fixed length, an upper base supported by the plurality of support posts, the upper base comprising at a plurality of handrails designed for the user to grab, and an adjustable height assembly designed to change a height of at least one of the upper base and the plurality of handrails.

In a seventh aspect, the adjustable height assembly comprises a sliding socket designed to allow the upper base to slide up and down a length of the support posts.

In an eighth aspect, the adjustable height assembly comprises a spring system connected to the plurality of handrails, and wherein the spring system is designed to lower the plurality of handrails when the user applies a force to the spring system.

In a ninth aspect, the plurality of handrails comprises a first lower handrail and a second lower handrail, and wherein each of the first lower handrail and the second lower handrail are approximately parallel to the deck.

In a tenth aspect, the upper base comprises a central control station at a fixed height, and wherein the adjustable height assembly is designed to change the height of the plurality of handrails regardless of the fixed height of the central control station.

In yet another instance, the cardiac enhancement training device comprises an exercise platform comprising, a deck designed to support a user, a belt designed to move around the deck, and a motor designed to drive the movement of the belt. The cardiac enhancement training device can further comprise a frame comprising a plurality of support posts, an upper base supported by the plurality of support posts, the upper base comprising at least one handrail designed for the user to grab, and a central control station designed to receive a plurality of user data inputs. Still further, the cardiac enhancement training device can comprise a controller designed to determine an optimal height of the at least one of the upper base and the handrail based on the plurality of user data inputs, and an adjustable height assembly designed to change a height of at least one of the upper base and the handrail from a first height to the optimal height.

In a twelfth aspect, the plurality of user data inputs includes a user heart rate, a user height, a user weight, a user age, a user fitness level, and an exercise intensity level.

In a thirteenth aspect, the user heart rate can be sensed by at least one of a contact heart rate sensor included in the upper base and a wearable heart rate monitor.

In a fourteenth aspect, the central control station comprises a receiver designed to receive the user heart rate from the wearable heart rate monitor.

In a fifteenth aspect, the adjustable height assembly is a manual adjustable height assembly designed to be operated by a user.

In a sixteenth aspect, the adjustable is an automatic adjustable height assembly designed to be controlled by the controller.

In a seventeenth aspect, the controller is designed to control a speed of the belt based on at least one of the plurality of user data inputs.

In an eighteen aspect, the exercise platform comprises a weight sensor designed to sense a weight of the user.

In a nineteenth aspect, the controller is designed to determine a user threshold heart rate.

In a twentieth aspect, the controller is designed to determine a weight threshold for a user's joints.

Further provided is a frame for use with a cardiac enhancement training device. The frame includes a height adjustment system including one or more handrails designed for a user to brace themselves on and relieve a first amount of weight from a user's joints, and an anti-gravity support system including one or more anti-gravity straps designed to relieve a second amount of weight from user's lower joints.

In a twenty-second aspect, the frame includes one or more vertical posts, and a slidable track connected to the one or more vertical posts, wherein the one or more handrails are connected to the slidable track.

In a twenty-third aspect, a tension force applied to the slidable track is provided by one or more bands designed to support the first amount of weight.

In a twenty-fourth aspect, the anti-gravity system includes one or more anti-gravity straps designed to be attached to a user.

Further provided is a method for controlling an operational setting of a cardiac enhancement training device during a workout program. The method comprises the steps of determining a plurality of user inputs for a user, determining a target heart rate range for the user based on at least one of the plurality of user inputs, determining an initial operational setting of the cardiac enhancement training device based on at least one user input of the plurality of user inputs, wherein the initial operational setting comprises a speed setting of the cardiac enhancement training device and a height setting of the cardiac enhancement training device, determining a heart rate of the user during the workout program, determining the heart rate of the user is outside of the target heart rate range, and changing the initial operational setting based on the determined heart rate of the user.

In a twenty-sixth aspect, the plurality of user inputs comprises a user height, a suer age, a user resting heart rate, a user maximum heart rate, a workout exercise intensity, a user body weight, and a user weight threshold.

In a twenty-seventh aspect, the initial operational setting based on the determined heart rate of the user comprises changing the height setting of the cardiac enhancement training device.

In a twenty-eighth aspect, the height setting of the cardiac enhancement training device comprises raising the height setting.

In a twenty-ninth aspect, the height setting of the cardiac enhancement training device comprises lowering the height setting.

In a thirtieth aspect, the height setting comprises a handrail height of a handrail of the cardiac enhancement training device.

In a thirty-first aspect, the height setting comprises an upper base height of an upper base of the cardiac enhancement training device.

In a thirty-second aspect, the heart rate of the user is determined by at least one of a contact heart rate sensor included in the cardiac enhancement training device and a wearable heart rate monitoring device.

In a thirty-third aspect, changing the initial operational setting based on the determined heart rate of the user comprises increasing the speed setting when the determined heart rate of the user is below the target heart rate range.

In a thirty-fourth aspect, changing the initial operational setting based on the determined heart rate of the user comprises decreasing the speed setting when the determined heart rate of the user is above the target heart rate range.

BRIEF DESCRIPTION OF THE DRAWINGS

In the drawings forming a part of this disclosure.

Figure 1:
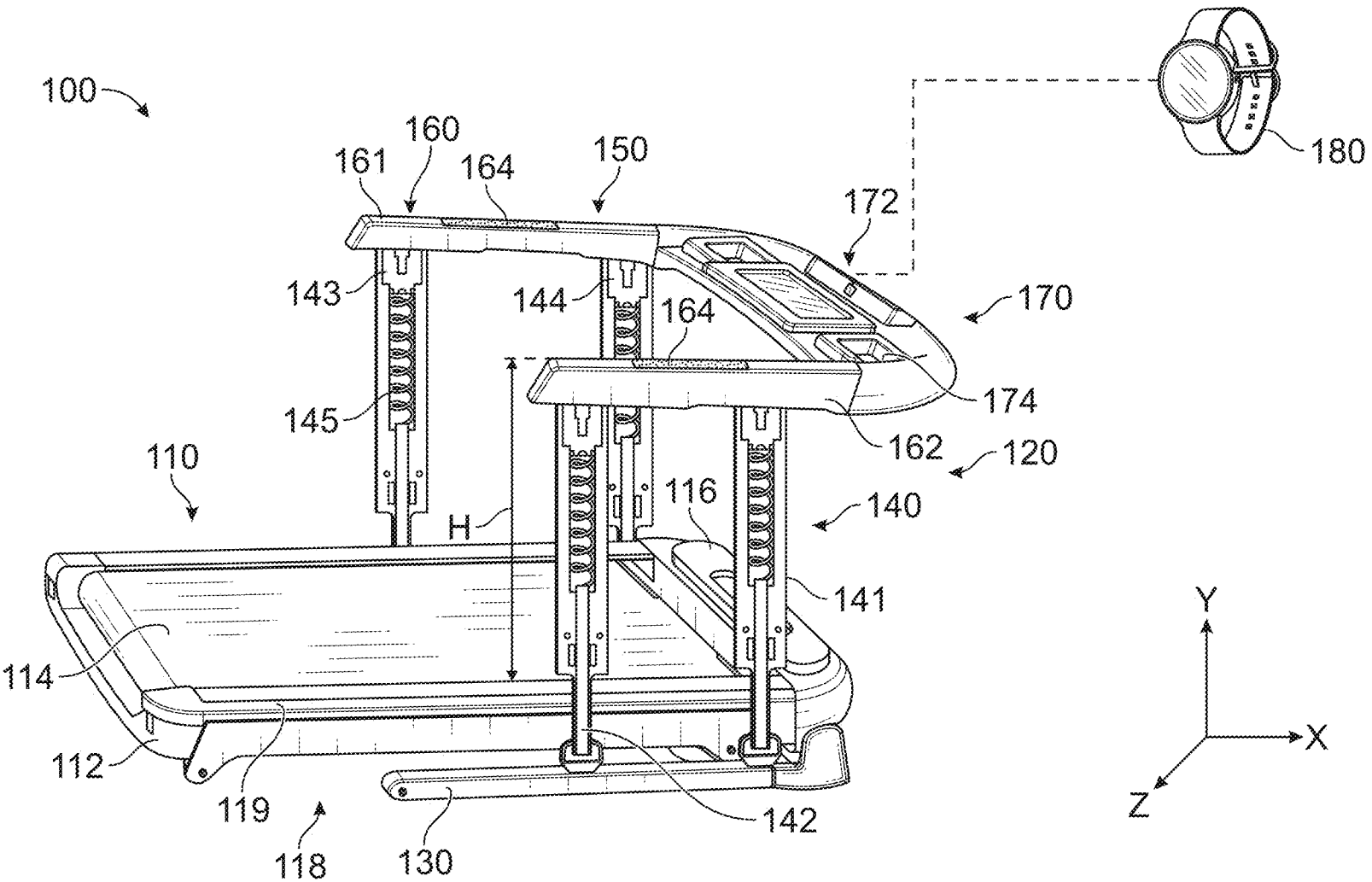
FIG. 1 illustrates a side isometric view of a cardiac enhancement training device in accordance with an illustrated embodiment of the invention.

Before explaining the disclosed embodiment of the present invention in detail, it is to be understood that the invention is not limited in its application to the details of the particular arrangement shown since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components set forth in the following description or illustrated in the attached drawings. The invention is capable of other embodiments and of being practiced or of being carried out in various ways. Also, it is to be understood that the phraseology and terminology used herein are for the purpose of description and should not be regarded as limiting. For example, the use of "including," "comprising," or "having" and variations thereof herein is meant to encompass the items listed thereafter and equivalents thereof, as well as additional items.

As shown in FIGS. 1-4, the embodiments of this disclosure include a cardiac enhancement training device. The cardiac enhancement training device can be provided in the form of a treadmill. Referring first to FIG. 1, a cardiac enhancement training device 100 is depicted. The cardiac enhancement training device 100 can include an exercise platform 110 and a frame 120.

The exercise platform 110 can include a deck 112, a belt 114, a motor 116, a shock absorption system 118, and a weight sensor 119. The deck 112 can be an approximately flat surface designed to provide support for the belt 114. The belt 114 can be wrapped around the deck 112. A drive system such as rollers and/or a pulley system can be designed to transfer rotational motion from the motor 116 to the belt 114 so that the belt 114 moves around the deck 112 in the z-direction. Thus, a user can walk, jog, or run on the exercise platform 110 because the belt 114 moves. As shown, the motor 116 is positioned near a front area of the exercise platform 110. However, the motor 116 can be positioned near the rear of the exercise platform 110 or under the exercise platform 110. The shock absorption system 118 can be included in or under the deck 112. The shock absorption system 118 can be designed to absorb some of the impact of a user's steps to reduce stress on the user's joints. The weight sensor 119 can be located in or on the exercise platform 110. The weight sensor 119 can be designed to sense a weight of a user on the cardiac enhancement training device 100. For instance, the weight sensor 119 can be located under the belt 114 such that when a user stands on the deck 112, the weight sensor 119 can sense the user's weight.

The frame 120 can include a lower base 130, support posts 140, and an upper base 150. The exercise platform 110 can be connected to the lower base 130. Thus, the lower base 130 can be designed to provide support for the exercise platform 110. The support posts 140 can be attached to the lower base 130 and be designed to support the upper base 150. As shown, the support posts 140 include four support posts 141-144. However, it is to be understood that the cardiac enhancement training device 100 can include more or fewer support posts 140.

The cardiac enhancement training device 100 can include a height adjustment assembly 145 designed to adjust a height "H" of at least a portion of the upper base 150 relative to the deck 112. In some instances, the height adjustment assembly 145 can be designed to modify a length of the support posts 140 in the vertical or y-direction. Thus, by modifying the length of the support posts 140, the height "H" of the upper base 150 can be adjusted because the height of the upper base 150 can be based on the length of the support posts 140.

As depicted, at least some portion of the support posts 140 can be hollow. Thus, each of the support posts 140 can include a height adjustment assembly 145. In some instances, the height adjustment assembly 145 includes one or more springs. The pressure on the spring(s) can be adjusted so that the spring(s) are either compressed or decompressed, thereby shortening or lengthening the spring(s). Consequently, the height "H" of the upper base 150 can be adjusted based on the compression of the spring(s). In other instances, the height adjustment assembly 145 can include a hydraulic cylinder designed to raise or lower a piston, thereby increasing or decreasing the length of the support posts 140.

The upper base 150 can include handrails 160 and a central control station 170. As shown, the cardiac enhancement training device 100 can include a first handrail 161 and a second handrail 162. However, it is to be understood that the cardiac enhancement training device 100 can include more or fewer handrails 160. In some instances, the handrails 160 can include a contact heart rate sensor 164. The contact heart rate sensor 164 can be a contact heart rate sensor designed to sense the user's heart rate. In some instances, the user's heart rate can be detected by an external heart rate monitor. For example, the user can wear a heart rate monitoring device 180. The wearable heart rate monitoring device 180 can be a chest strap heart rate monitor, a wrist band heart rate monitor, an armband heart rate monitor, or any other heart rate monitor known in the art. Data from the wearable heart rate monitoring device 180 can be received by the cardiac enhancement training device 100 via a receiver 172 included in the central control station 170.

The central control station 170 can further include a controller 174 designed to receive user data, interpret the user data, and control one or more operational settings of the cardiac enhancement training device 100. The user data can include a weight of the user sensed by the weight sensor 119, a speed of the belt 114, the height "H" of the height of the upper base 150 and/or the handrails 160, and the user's heart rate detected by the contact heart rate sensor 164 and/or the wearable heart rate monitoring device 180. The one or more operational settings can include the speed of the belt 114 and the height "H" of the upper base 150.

Figure 2:
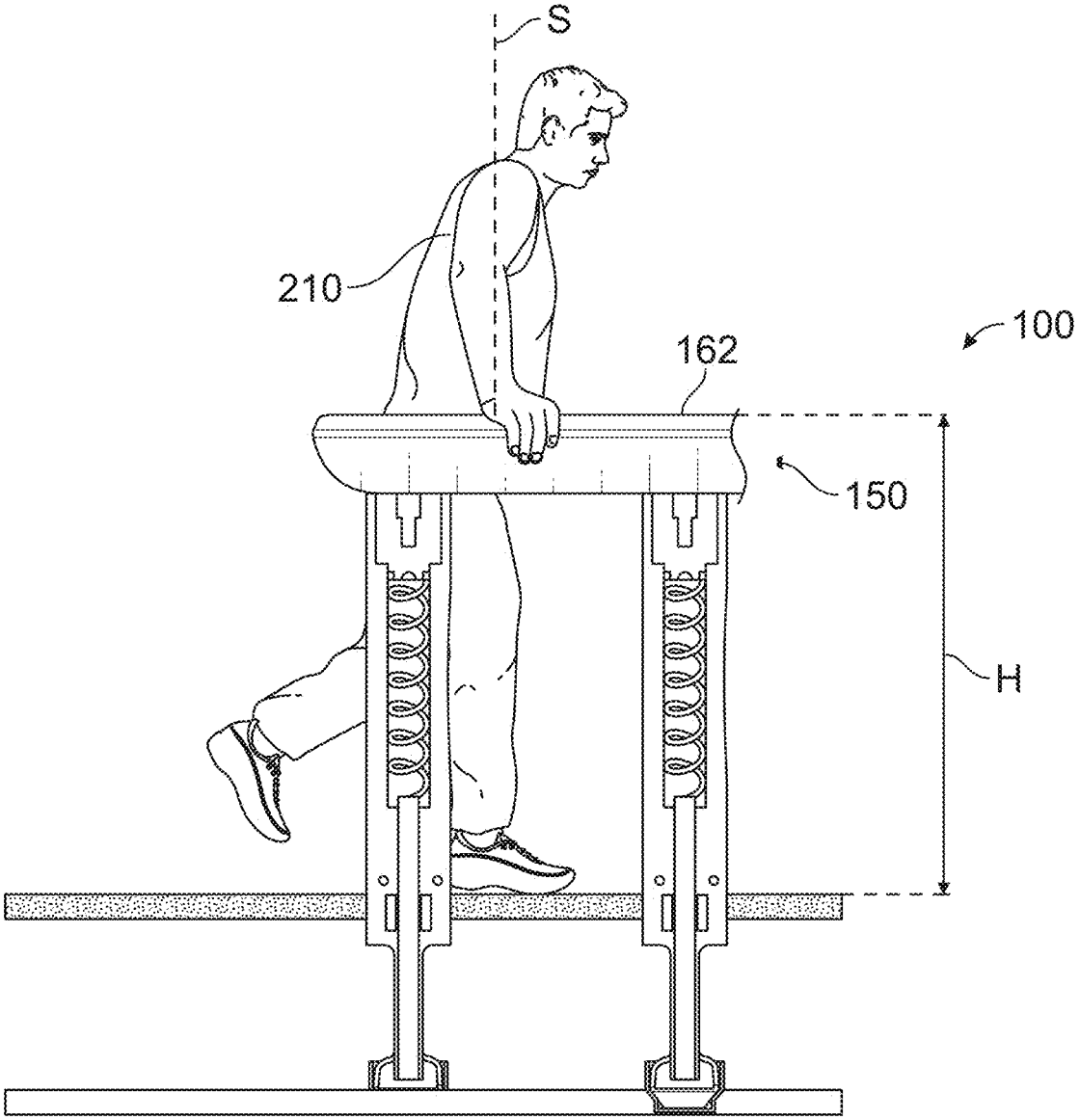
FIG. 2 illustrates a user exercising on the cardiac enhancement training device of FIG. 1.

Now, referring to FIG. 2, a user 210 exercising on the cardiac enhancement training device 100 is shown. As depicted, the user 210 is exercising on the cardiac enhancement training device 100 and supporting themselves by bracing their arms on the first handrail 161 (not shown) and the second handrail 162. Thus, the user 210 can relieve some of the pressure on their lower joints by supporting some of their weight with their upper body. Accordingly, the user 210 may be less likely to injure themselves because the user's lower joints may be less stressed from the decreased weight put on their lower joints. Further, the user 210 may be more likely to complete their workout if they can prevent an injury.

As shown, it may be easier for the user 210 to support some of their weight if the handrails 160 of the upper base 150 are at a height where the user 210 can extend their arms in an approximately straight line "S." However, not all users are the same height. Therefore, it can be beneficial to adjust the height "H" of the upper base 150 so that different users can support themselves with approximately straight arms regardless of the user's height.

Figure 3:
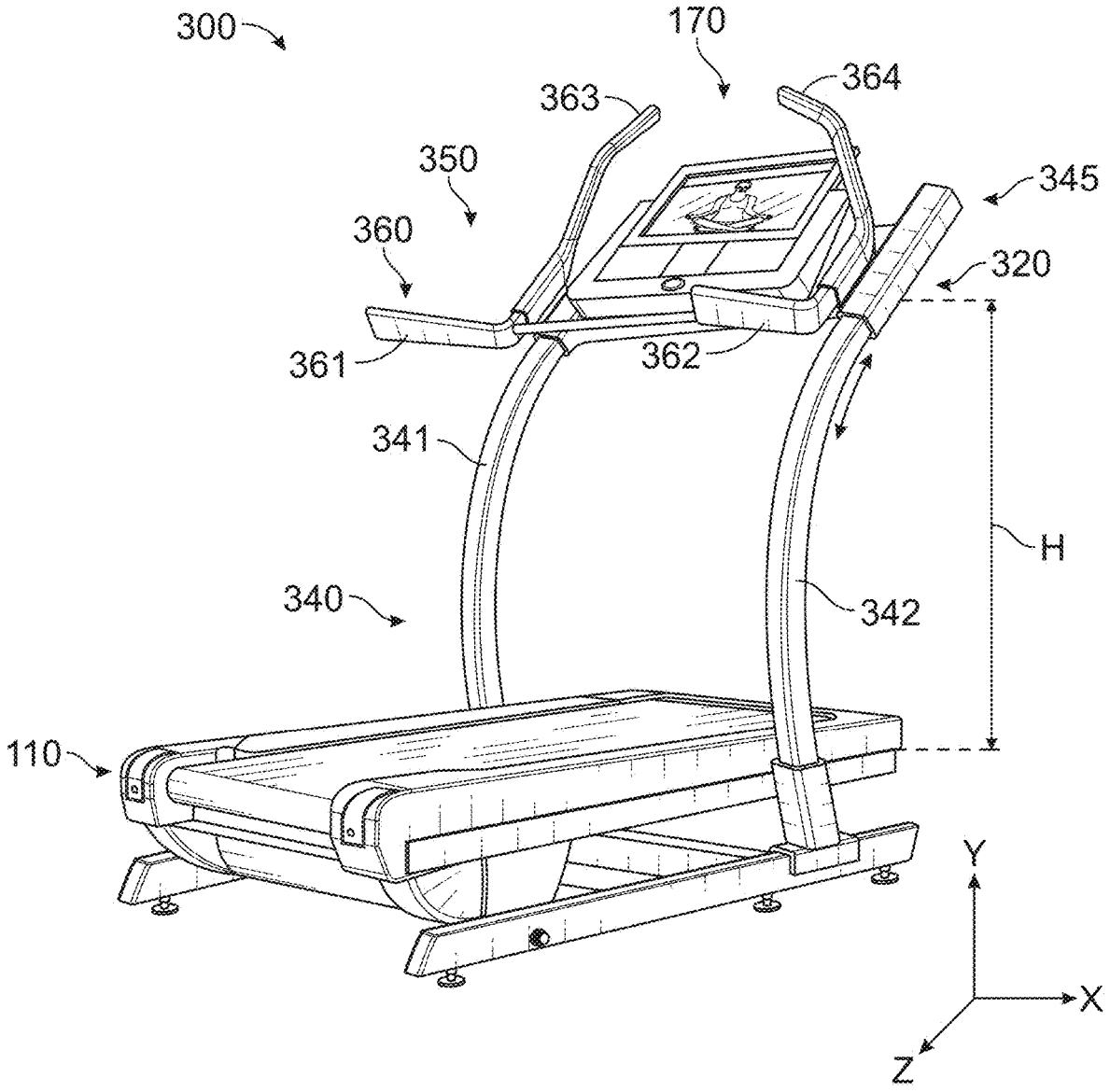
FIG. 3 illustrates a side isometric view of a cardiac enhancement training device in accordance with another illustrated embodiment of the invention.
Figure 4:
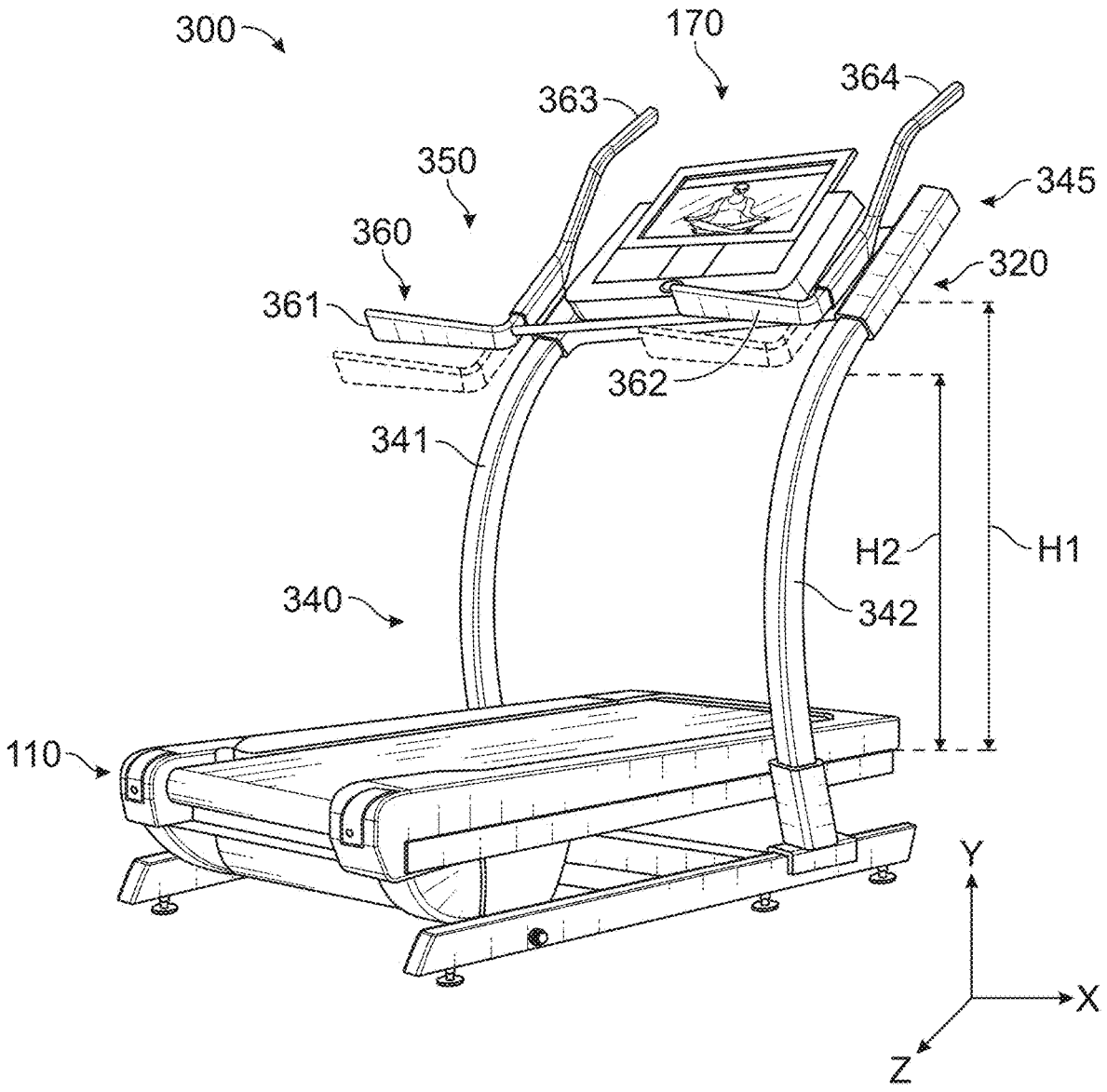
FIG. 4 illustrates a side isometric view of a cardiac enhancement training device of FIG. 3 where a height of a handrail has been adjusted.

Referring next to FIGS. 3 and 4, a cardiac enhancement training device 300 is illustrated. The cardiac enhancement training device 300 is similar to the cardiac enhancement training device 100 of FIGS. 1 and 2. However, a frame 320 can be different (e.g., compared to the frame 120 of FIG. 1). Specifically, the number of support posts, the upper base, and the height adjustment assembly can differ of the frame 320 can differ.

As shown, the cardiac enhancement training device 300 includes support posts 340, including a first support post 341 and a second support post 342. In some instances, the support posts 340 are fixed posts. Thus, the length of the support posts 340 in the y-direction may not be variable.

Similar to the upper base 150 of FIG. 1, the upper base 350 can include handrails 360. Here, the upper base 350 can include four handrails 361-364. A first lower handrail 361 and a second lower handrail 362 can be oriented so that they are approximately parallel with the exercise platform 110. Accordingly, similar to the user 210 in FIG. 2, a user can brace themselves on the first lower handrail 361 and the second lower handrail 362 so that the user can relieve some of the pressure on their lower joints. Further, the upper base 350 can include a first upper handrail 363 and a second upper handrail 364. The first upper handrail 363 and the second upper handrail 364 can be oriented at about a 60° angle to about a 120° angle relative to each of the first lower handrail 361 and the second lower handrail 362. The first upper handrail 363 and the second upper handrail 364 can provide additional contact points for a user to grab onto while exercising. Further, similar to the handrails 160, each of the handrails 360 can include a contact heart rate sensor 164.

As discussed above, it can be beneficial to adjust a height "H" of at least a portion of the upper base 350 so that a user can support themselves while exercising. In particular, it can be helpful to adjust the height of the handrails 360 because the handrails 360 can be designed for the user to grab onto. Thus, a height adjustment assembly 345 can be designed to adjust the height "H" of the handrails 360 of the upper base 350 regardless of the height of the support posts 340.

As shown best in FIG. 3, in some instances, the height adjustment assembly 345 can be designed to adjust the height "H" of the entire upper base 350 (i.e., the central control station 170 and the handrails 360). The height adjustment assembly 345 can include a sliding socket, such as a rail or track, that allows the upper base 350 to slide up and down the length of the support posts 340 in the y-direction.

Conversely, as shown in FIG. 4, in other instances, the height adjustment assembly 345 can be designed to adjust the height "H" of the handrails 360 without changing the height of the central control station 170. As depicted, the height of the first lower handrail 361, and the second lower handrail 362 can be adjusted from a first height, "H1," to a second height, "H2". In some instances, the height adjustment assembly 345 can be provided in the form of one or more springs located in or connected to the first and second lower handrails 361, 362. Thus, when a user braces themselves on the first and second lower handrails 361, 362, the spring(s) can be compressed, resulting in the height of the first and second lower handrails 361, 362 being adjusted from the first height "H1" to the second height "H2." In other instances, the height adjustment assembly 345 can include a sliding socket that allows the first and second lower handrails 361, 362 to slide up and down the length of the support posts 340 in the y-direction.

In addition to adjusting the height "H" of the handrails 360 and/or the upper base 350, adjusting the speed of the belt 114 of the cardiac enhancement training devices 100 and 300 can be beneficial. As mentioned above, it can be beneficial for a user to maintain their heart rate within a target heart rate range. However, it can be difficult for a user to continuously monitor their heart rate, determine whether they are within their target heart rate range, and adjust one or more operating parameters of the cardiac enhancement training device accordingly. For instance, both the speed of the belt and the height of the handrails 360 and/or the upper base 350 can affect a user's heart rate. At higher belt speeds, a user's heart rate can increase. Likewise, a user's heart rate can increase if they are supporting their body weight without the aid of handrails. Accordingly, a method for analyzing a plurality of user inputs and controlling the cardiac enhancement training device based on those inputs is disclosed herein.

Figure 5:
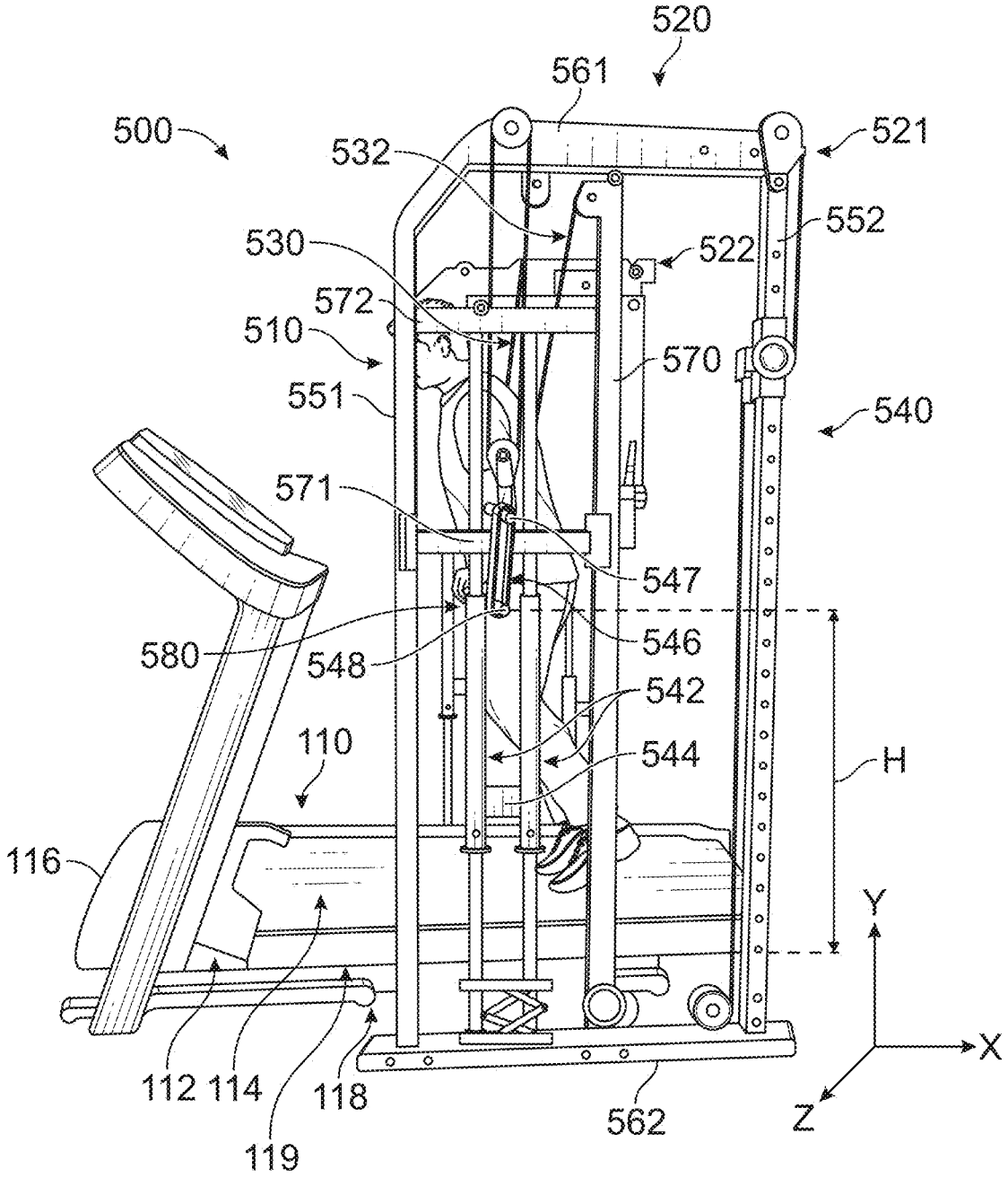
FIG. 5 illustrates a side elevational view of a user on a cardiac enhancement training device according to another illustrated embodiment of the invention.

Referring to FIG. 5, a user 510 is shown on a cardiac enhancement training device 500. The cardiac enhancement training device 500 is similar to the cardiac enhancement training devices 100 of FIGS. 1 and 2, and 300 of FIGS. 3 and 4. However, the cardiac enhancement training device 500 can include a different frame 520 (e.g., as compared to the frame 120 of FIGS. 1 and 2, and 320 of FIGS. 3 and 4). Specifically, the frame 520 can include an anti-gravity support system 530 and a height adjustment system 540.

The frame 520 can include a first lateral support frame 521 and a second lateral support frame 522. The first lateral support frame 521 and the second lateral support frame 522 can be connected via one or more cross beams (not shown). For example, the frame 520 can include a bottom cross beam designed to be positioned under the exercise platform 110 and connect to each of the first lateral support frame 521 and the second lateral support frame 522. Alternatively, or in addition, the frame 520 can include a top cross beam designed to be positioned above the exercise platform 110 and above a vertical height of the user 510 and connect to each of the first lateral support frame 521 and the second lateral support frame 522. Accordingly, the bottom cross beam and/or the top cross beam can provide stability for the frame 520.

The first lateral support frame 521 and the second lateral support frame 522 can be mirror images of each other. Thus, for brevity, only the first lateral support frame 521 will be described in detail. However, it is to be understood that the second lateral support frame 522 can include similar features.

As shown, the first lateral support frame 521 can include a first vertical portion 551 and a second vertical portion 552 approximately parallel to the first vertical portion 551. The frame 520 can further include a first horizontal portion 561 and a second horizontal portion 562 approximately parallel to the first horizontal portion 561. Each of the first horizontal portion 561 and the second horizontal portion 562 can be positioned at an approximate 90° angle from the first vertical portion 551 and the second vertical portion 552. The first vertical portion 551, the second vertical portion 552, the first horizontal portion 561, and the second horizontal portion 562 can be connected together such that an approximately rectangular shape is formed.

Further, in some instances, the first lateral support frame 521 can include various cross beams (e.g., additional cross beams from the top cross beam and the bottom cross beam mentioned above). As illustrated, the first lateral support frame 521 can include a vertical cross beam 570 connected to the first horizontal portion 561 and the second horizontal portion 562 and positioned between and approximately parallel to the first vertical portion 551 and the second vertical portion 552. The first lateral support frame 521 can further include a first horizontal cross beam 571 connected to the first vertical portion 551 and the vertical cross beam 570 and positioned approximately parallel to the first horizontal portion 561 and/or the second horizontal portion 562. In still other instances, the first lateral support frame 521 can include a second horizontal cross beam 572.

A benefit of the frame 520 is that in some instances, the frame 520 can be separated from the remaining cardiac enhancement training device 500 (e.g., the exercise platform 110, the deck 112, the belt 114, the motor 116, the shock absorption system 118, and the weight sensor 119). For instance, the frame 520 can be attached to or incorporated with an exercise device such as a treadmill or elliptical that does not include an adjustable height assembly and/or an anti-gravity support system. Thus, a benefit of the frame 520 is that the frame 520 can be easily installed on cardiac enhancement training devices that a user may already own. Accordingly, the user can utilize the frame 520 to make an existing cardiac enhancement training device safer without the need to purchase an entire new cardiac enhancement training device. However, in other instances, the frame 520 can be integral with (e.g., not detachable) the remainder of the cardiac enhancement training device 500. Thus, the cardiac enhancement training device 500 can be provided as an all-in-one system (e.g., a system including an exercise device such as a treadmill or an elliptical, an anti-gravity support system, and a height adjustment system).

Features of the anti-gravity support system 530 will now be described. As shown and discussed below, the anti-gravity support system 530 can be designed to alleviate pressure on a user's lower joints by providing a lifting or anti-gravity force on the user 510. The anti-gravity support system 530 can include one or more anti-gravity straps 532. As shown in one instance, the anti-gravity support system 530 can include two anti-gravity straps 532. A first anti-gravity strap can be connected to the first lateral support frame 521, and a second anti-gravity strap can be connected to the second lateral support frame 522. Referring to just the first lateral support frame 521, it can be seen that the anti-gravity straps 532 can be connected to the vertical cross beam 570 near the first horizontal portion 561. However, it is to be understood that the anti-gravity strap 532 can be connected to any portion of the first lateral support frame 521.

The anti-gravity straps 532 can be elastic bands, such as bungee cords or resistance bands, designed to support a pre-determined amount of weight. In some instances, the anti-gravity straps 532 can support at least 5 pounds, at least 10 pounds, at least 20 pounds, at least 30 pounds, at least 40 pounds, at least 50 pounds, or at least 75 pounds, or at least 100 pounds.

During operation of the cardiac enhancement training device 500, the user 510 can connect the anti-gravity straps 532 to themselves. Thus, the anti-gravity straps 532 can provide a lifting force approximately equal to the amount of weight the anti-gravity strap 532 is designed to support. Accordingly, the amount of weight supported by the anti-gravity straps 532 can be alleviated from the user 510, which can make it easier for the user 510 to exercise because there can be less weight on the user's 510 joints.

Figure 6:
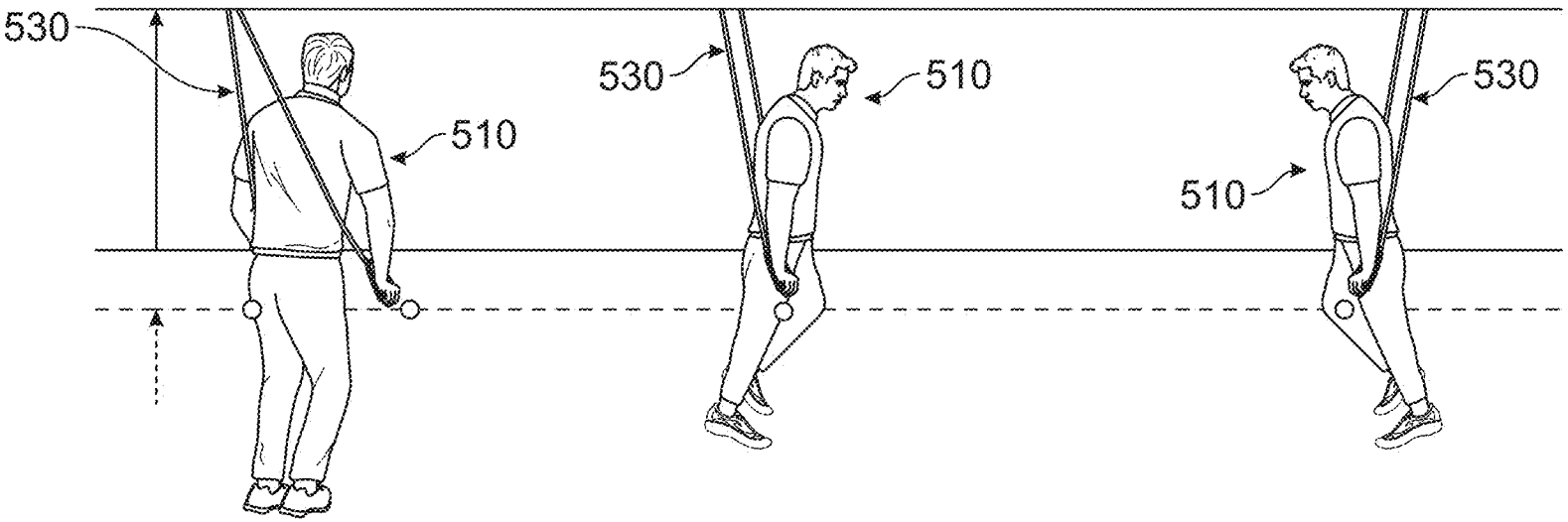
FIG. 6 illustrates various views of a user using an anti-gravity support system of the cardiac training enhancement device of FIG. 5.

As shown best in FIG. 6, the user 510 can attach the anti-gravity straps 532 to their waist region. In some instances, the anti-gravity straps 532 can include clips, hooks, a belt, or other attachment mechanisms designed to connect to a user's garments or body. For example, the user 510 can attach the anti-gravity straps 532 to belt loops on their clothing. In another example, the user 510 can secure a belt to their waist and attach the anti-gravity straps 532 to their waist. In still another example, the user 510 can wear a special garment designed to work in conjunction with the anti-gravity straps (i.e., a garment that includes attachment points for the anti-gravity straps).

A benefit of the anti-gravity support system 530 is that in addition to relieving pressure from the user's 510 joints, the user 510 can be less likely to injure themselves because the anti-gravity straps 532 may prevent the user 510 from falling. Another benefit of the anti-gravity straps 532 is that the user's hands can remain free because the user 510 may not need to grasp the anti-gravity straps 532. Thus, the user 510 can use their hands for other purposes such as holding on to a handrail. Accordingly, the cardiac training device 500 can include a height adjustment system 540 having one or more handrails.

Referring back to FIG. 5, it can be seen that two handrails 580 can be included in, or attached to, the frame 520 (e.g., a first handrail corresponding to the first lateral support frame 521 and a second handrail corresponding to the second lateral support frame 522). The first and second handrails can be similar. Accordingly, for brevity, the first and second handrails will be referred to as the "handrails 580." Similar to the handrails 160 of FIGS. 1 and 2 and 360 of FIGS. 3 and 4, a height "H" of the handrail 580 can be adjusted via the height adjustment system 540.

The height adjustment system 540 can include one or more vertical posts 542. The handrails 580 can be attached to the one or more vertical posts 542. Further, the handrails 580 can be designed to slide up and down the one or more vertical posts 542 in the y-direction. Thus, to adjust the height "H" of the handrails 580, the user 510 can apply a downward force in the y-direction to the handrails 580.

In some aspects, the handrails 580 can be attached to a sleeve or slidable track 544 attached to, or part of, the one or more vertical posts 542. The one or more vertical posts 542 may be stationary posts and a slidable track 544 can be designed to move up or down the one or more vertical posts 542 in the y-direction. Accordingly, the height "H" of the handrails 580 can be adjusted based on the position of the slidable track 544. In some instances, the position of the slidable track 544 can be adjusted via a spring system or pneumatic system, as described above. In other instances, the position of the slidable track 544 can be adjusted via a band system 546.

The band system 546 can include one or more bands designed to provide a tension force on the slidable track 544. In some instances, the one or more bands can support at least 5 pounds, at least 10 pounds, at least 20 pounds, at least 30 pounds, at least 40 pounds, or at least 50 pounds.

As shown in one example, the band system 546 can include a first peg 547 and a second peg 548. The first peg 547 can be attached to the first horizontal cross beam 571. The second peg 548 can be attached to the slidable track 544. The one or more bands can be stretched over and between the first peg 547 and the second peg 548. Thus, when the user 510 applies a downward force to the handrail 580, and, in turn the slidable track 544, including the second peg 548, the bands of the band system 546 can stretch. A band that can support a lower amount of weight (e.g., 5 pounds) can stretch more than a band designed to support a greater amount of weight (e.g., 20 pounds) when a similar downward pressure is applied. Therefore, the user 510 can customize the weight supported by the handrails 580 by adjusting the bands. For instance, if the user 510 needs approximately 20 pounds of weight relieved from their lower joints, the user 510 can use a band designed to support 20 pounds.

Accordingly, similar to the systems and methods described above, in some instances, the cardiac enhancement training device 500 can be designed to assist the user 510 in determining how much weight they need relieved from their joints. For instance, as described above, the user 510 can input their health information into a controller included in the cardiac enhancement training device 500 (e.g., the controller 174 of FIG. 1). The controller 174 can recommend a weight amount to be relived from the user 510. The controller can then be designed to determine what combination of systems to use. For instance, if the user 510 needs approximately 20 pounds relieved from their lower joints, the controller can determine that approximately 10 pounds can be relieved using the anti-gravity support system 530 and approximately 10 pounds can be relieved using the adjustable height handrails 580. Further, in some instances, the controller can be designed to automatically adjust one or more systems (e.g., the anti-gravity support system 530 and a height adjustment system 540) of the cardiac training device 500 to meet the user's needs.

Figure 7:
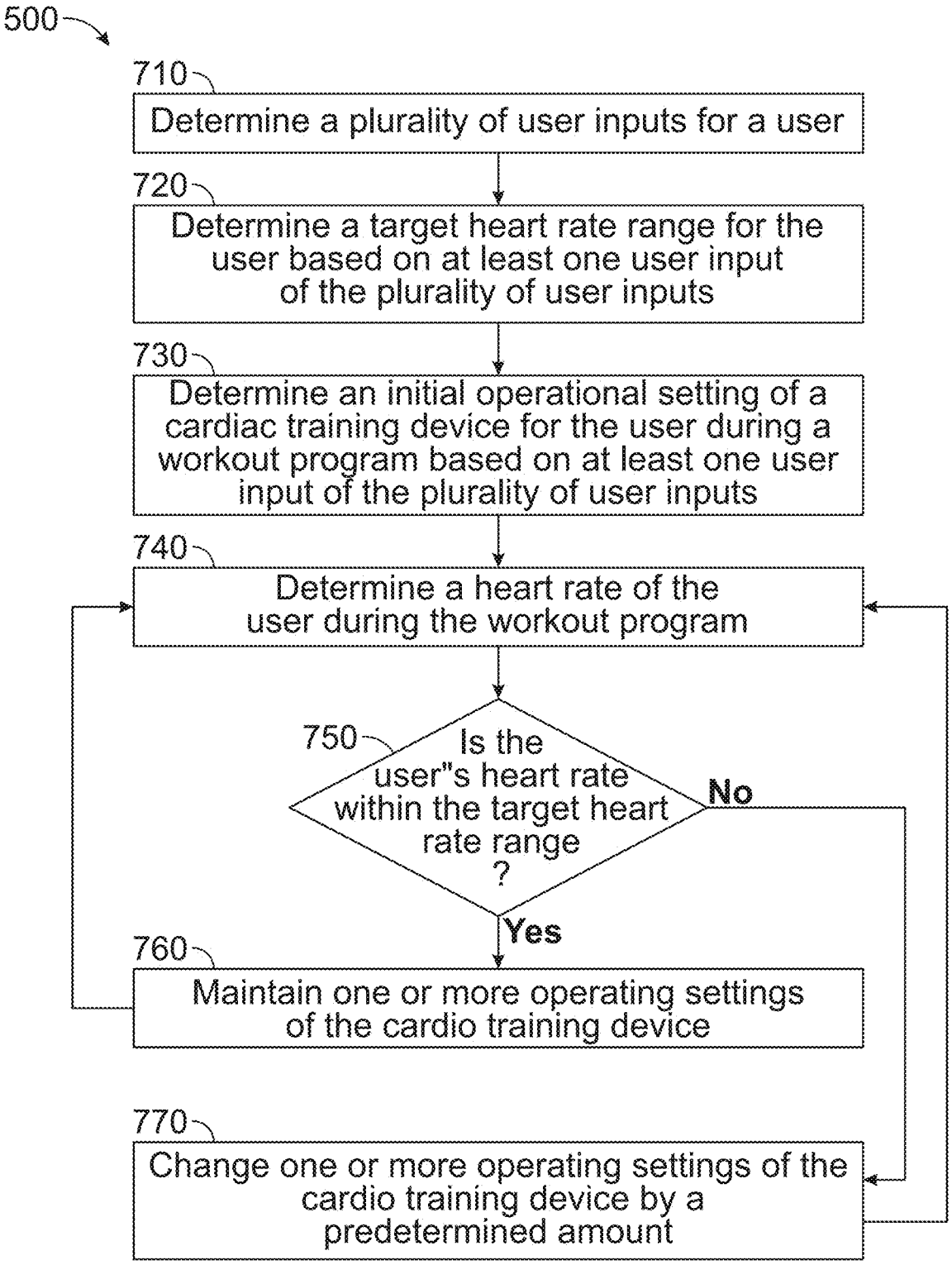
FIG. 7 illustrates a method for controlling one or more operational parameters of the cardiac enhancement training device of the embodiments disclosed herein.

Turning to FIG. 7, a method for controlling one or more operating parameters of the cardiac enhancement training device of the embodiments disclosed herein is shown. The method 700 can be implemented with the cardiac enhancement training device 100 of FIGS. 1 and 2 and the cardiac enhancement training device 300 of FIGS. 3 and 4.

At step 710, the controller 174 can be designed to determine a plurality of user inputs for a user. The plurality of user input can be determined prior to the user starting a workout program. The user inputs can include a height of the user, a user's age, a resting heart rate of the user, a maximum heart rate of the user, an exercise intensity for the workout, a body weight of the user, a weight threshold of a user's lower joints, and the like.

A user can enter one or more user inputs of the of the plurality of user inputs into an interface included in the central control station 170. For example, the central control station 170 can include an interface in the form of a touch screen where the user can enter data. In some instances, the controller 174 can be designed to prompt a user to enter the user inputs prior to beginning the workout. For instances, a user can select and enter their height and age on the interface.

Alternatively, or in addition to, the controller 174 can be designed to determine one or more user inputs of the of the plurality of user inputs using the weight sensor 117, the contact heart rate sensor 164, and/or the wearable heart rate monitoring device 180.

For instance, the user's body weight can be determined by the weight sensor 119 when the user steps on the cardio exercise device. The threshold weight can be a weight determined and entered by the user. Alternatively, the threshold weight can be determined by the controller 174. For instance, the controller 174 can determine the user's body weight via the weight sensor 119 and then determine a percentage of the sensed weight that the user's joint can withstand. The percentage of the sensed weight that the user's joint can withstand can be based on various user data inputs such as the user's age, fitness level, body weight, exercise intensity, and the like.

The user's resting heart rate can be determined and entered by the user. Alternatively, the controller 174 can determine the user's resting heart rate by sensing the user's heart rate via the contact heart rate sensor 164 and/or the wearable heart rate monitoring device 180 before the user begins their workout.

The exercise intensity can be selected by the user and can determine how strenuous the user's workout will be by affecting the user's target heart rate. The exercise intensity can include various intensity settings such as a low intensity, a medium intensity, a high intensity, and an extremely high intensity. The exercise intensity can be a percentage that the user selects. For instance, the low intensity setting can be about 60% to about 69%, the medium intensity can be about 70% to about 79%, the high intensity can be about 80% to about 89%, and the extremely high intensity can be about 90% to about 100%.

At step 730, the controller 174 can be designed to determine a target heart rate range of the user. The target heart rate of the user can be based on at least one user input of the plurality of user inputs. The user's target heart rate range can be the user's target heart rate +/−a threshold value. The threshold value can be a percentage, such as +/−10%. Alternatively, the threshold value can be a number of beats per minute (bpm), such as +/−10 bpm.

The user's target heart rate can be determined by Formula I.

Formula I $$\text{Target heart rate} = \text{Reserve heart rate} \times \text{Exercise Intensity} + \text{Resting heart rate}$$

The user's reserve heart rate can be determined by Formula II.

Formula II $$\text{Reserve heart rate} = \text{Maxiumum heart rate} - \text{Resting Heart Rate}$$

The user's maximum heart rate can be manually entered by the user at step 710. Alternatively, the user's maximum heart rate can be determined by Formula III.

$$\text{Maximum heart rate} = 220 - \text{the user's age} \qquad \text{Formula III}$$

At step 730, the controller 174 can be designed to determine an initial operational setting of the cardiac training device or the user during the workout program. The initial operational setting can be based on at least one of the user inputs of the plurality of user inputs. The initial operational setting can include an initial height setting and/or an initial speed of the belt 114. The initial height setting can be the height "H" of FIGS. 1-4.

The height setting can be based on one or more of the user inputs. For example, a user can enter their height via the input screen, and the controller 174 can be designed to determine an optimal height "H" for the user based on the user's entered height. Further, the controller 174 can be designed to determine the optimal height "H" based on a threshold weight of the user's lower joints. Further, the controller 174 can be designed to prompt the user to change the height "H" and/or the speed of the belt if needed.

As described above, a cardiac enhancement training device as disclosed herein, can include various height adjustment assemblies, such as the height adjustment assembly 145 of FIGS. 1 and 2 and the height adjustment assembly 345 of FIGS. 3 and 4. Accordingly, in some instances, the height setting can be adjusted manually (e.g., a spring system). Alternatively, in some instances, the height setting can be adjusted via the controller 174 (e.g., an automated piston system).

The initial speed setting can be based one or more user inputs of the plurality of user inputs. For instance, the controller 174 can be designed to determine the initial speed based on the user's target heart rate range. Further, the controller 174 can be designed to instruct the user to set the speed of the belt 114 to the initial speed, or the controller can be designed to automatically adjust the speed of the belt 114 to the initial speed once the user begins their workout program.

After the user begins their workout program, at step 740, the controller 174 can be designed to determine the user's heart rate. The controller 174 can determine the user's heart rate based on the heart rate sensed by the contact heart rate sensor 164 and/or the wearable heart rate monitoring device 180. Thus, in some instances, a two-layer structure can determine the user's heart rate to ensure a clear count of the user's pulse. Using two heart rate monitors (e.g., the contact heart rate sensor 164 and the wearable heart rate monitoring device 180) can be beneficial because the user may not maintain contact with the contact heart rate sensor 164 at all times, or one heart rate sensor can malfunction. The controller 174 can also include a filtering device designed to remove noise from the sensed heart rate(s). Further, the controller 174 can include an amplifier designed to boost a signal received from the contact heart rate sensor 164 and the wearable heart rate monitoring device 180.

At step 750, the controller 174 can be designed to determine whether the user's sensed heart rate is within a target heart rate range for the user.

If, at step 750, the controller 174 determines the user's sensed heart rate is within the target heart rate range, the method proceeds to step 760. At step 760, the controller 174 can be designed to maintain one or more operational settings of the cardiac enhancement training device. The one or more operational settings can include a speed setting (e.g., a speed of the belt 114) and the height "H" setting of the upper base and/or the handrails.

However, if at step 750, the controller 174 determines that the user's sensed heart rate is not within the target heart rate range, the method proceeds to step 770. At step 770, the controller 174 can be designed to change one or more cardiac enhancement training device operational settings. For instance, if the user's sensed heart rate is above or below the target heart rate range, the controller 174 can be designed to change the height "H" of the upper base and/or the handrails or instruct the user to change the height of the upper base and/or handrails. If the upper base and/or handrails are not at the correct height, it can be more difficult for the user to support themselves. Thus, the user's heart rate can increase because the user is exerting themselves.

In some aspects, the controller can also be designed to change, or recommend the user change, a feature of an anti-gravity support system (e.g., the anti-gravity support system 530 of FIGS. 5 and 6). For example, the controller can instruct a user to adjust the anti-gravity support system so that it can support more of the user's weight, thereby reducing the weight on the user's lower joints.

In some instances, if the user's heart rate is above than target heart rate range, the controller 174 can lower the speed setting by reducing the power of the motor 116. The controller 174 can also be configured to instruct the user to manually decrease the speed setting by making a speed selection on the central control station 170. Conversely, if the user's heart rate is below the target heart rate range, the controller 174 can be designed to automatically raise, or instruct the user to increase the speed setting by increasing the power of the motor 116. In some instances, the controller 174 can be designed to increase or decrease the speed setting by a threshold amount, such as +/−10% of the belt 114 speed. However, it is to be understood that the threshold amount can be any value.

Following steps 760 and 770, the method can return to step 740 and continue to monitor the user's heart rate until the user's workout is completed. Thus, steps 740-770 can be repeated multiple times throughout the user's workout. As such, the user can be more likely to finish their workout without prematurely stopping or injuring themselves because the method 700 can help keep the user's heart rate within a desired range. Accordingly, the systems and methods described herein can be more beneficial than traditional cardio exercise systems and methods.

Specific embodiments of a cardiac enhancement training device and a method of controlling a cardiac enhancement training device have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

What is claimed:

1. A frame for use with a cardiac enhancement training device, the frame comprising:

a first lateral support frame and a second lateral support frame, each lateral support frame comprising:

a first vertical portion, a second vertical portion, a first horizontal portion, and a second horizontal portion connected together to form an approximately rectangular shape, the first horizontal portion spaced a vertical distance above the second horizontal portion;

a vertical cross beam connected to and between the first and second horizontal portions, the vertical cross beam being between and approximately parallel to the first and second vertical portions; and a first horizontal cross beam spaced a vertical distance above a second horizontal cross beam, the first and second horizontal cross beams connected to and between the first vertical portion and the first vertical cross beam, the first and second horizontal cross beams being between and approximately parallel to the first and second horizontal portions;

a height adjustment system comprising:

one or more handrails designed for a user to brace themselves on and relieve a first amount of weight from joints of the user;

one or more vertical posts connected to and between the first horizontal cross beam and the second horizontal portion, the one or more vertical posts being between and approximately parallel to the first vertical portion and the vertical cross beam; and a slidable track connected to the one or more handrails and connected to and between the one or more vertical posts, the slidable track being slidable up and down along the one or more vertical posts, wherein a tension force applied to the slidable track is provided by one or more bands designed to support the first amount of weight; and an anti-gravity support system including one or more anti-gravity straps designed to relieve a second amount of weight from lower joints of the user.

2. The frame of claim 1, wherein the one or more bands are connected to the second horizontal cross beam via a first peg.

3. The frame of claim 2, wherein the one or more bands are connected to the slidable track via a second peg.

4. The frame of claim 1, wherein the frame can be separated from the cardiac enhancement training device.

5. The frame of claim 1, wherein the frame is integral with the cardiac enhancement training device.

6. The frame of claim 1, wherein the cardiac enhancement training device is provided in the form of:

an exercise platform comprising a deck designed to support the user;

a belt designed to move around the deck; and a motor designed to drive the movement of the belt.

7. The frame of claim 6, wherein the cardiac enhancement training device further includes a shock absorption system.

8. The frame of claim 6, wherein the cardiac enhancement training device includes a controller designed to determine an amount of weight to be relieved from the user's joints.

9. The frame of claim 8, wherein the controller is further designed to automatically adjust the anti-gravity support system and the height adjustment system.

10. The frame of claim 8, wherein the controller is additionally designed to:

determine a target heart rate range for the user, determine a heart rate of the user during a workout program, determine if the heart rate of the user is outside of the target heart rate range, and change an initial operational setting of the cardiac enhancement training device based on the determined heart rate of the user.

11. The frame of claim 6, wherein a weight sensor is located under the belt to sense a weight of the user.

12. The frame of claim 1, wherein the one or more anti-gravity straps includes a first anti-gravity strap and a second anti-gravity strap, the first anti-gravity strap connected to the first lateral support frame, and the second anti-gravity strap connected to the second lateral support frame.

13. The frame of claim 1, wherein a position of the slidable track is adjustable via a spring system or a pneumatic system.

14. The frame of claim 1, wherein the one or more anti-gravity straps are bungee cords.

15. The frame of claim 1, wherein the one or more anti-gravity straps include clips, hooks, and/or belts for connection to a garment or body of the user.

* * * * *